US007201623B1

(12) United States Patent
Krupp et al.

(10) Patent No.: US 7,201,623 B1
(45) Date of Patent: Apr. 10, 2007

(54) INERTIAL LOCK FOR AN OUTBOARD COWL

(75) Inventors: Timothy D. Krupp, Fond du Lac, WI (US); Thomas J. Walczak, Oconomowoc, WI (US); Randall J. Holland, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 11/251,289

(22) Filed: Oct. 14, 2005

(51) Int. Cl.
*B63H 20/32* (2006.01)

(52) U.S. Cl. ..... 440/77

(58) Field of Classification Search ..... 440/77
See application file for complete search history.

(56) References Cited

U.S. PATENT DOCUMENTS 4,875,883 A 10/1989 Slattery ..... 440/77
4,927,194 A 5/1990 Wagner ..... 292/128
5,803,777 A * 9/1998 Hiraoka ..... 440/77
6,669,517 B1 12/2003 Alby et al. ..... 440/77
6,682,379 B1 1/2004 Walczak et al. ..... 440/77
6,991,500 B1 * 1/2006 Gulko et al. ..... 440/77

OTHER PUBLICATIONS

U.S. Appl. No. 11/070,760, filed Mar. 2, 2005, Gulko et al.

* cited by examiner

*Primary Examiner*—Stephen Avila
(74) *Attorney, Agent, or Firm*—William D. Lanyi

(57) ABSTRACT

A locking system is provided for the cowl structure of an outboard motor. An impulse sensitive locking mechanism is configured to rotate into a locking position in response to an impact, or impulse force, exerted against the outboard motor. This rotation of the impulse sensitive locking mechanism prevents a retention component of the latch structure from moving toward an unlatched position in response to the impact exerted on the outboard motor. This, in turn, prevents the first and second latch members from disengaging with each other and allowing a portion of the cowl to disengage from the outboard motor.

20 Claims, 6 Drawing Sheets

INERTIAL LOCK FOR AN OUTBOARD COWL

BACKGROUND OF THE INVENTION

1. Field of the Invention

The present invention is generally related to a retaining mechanism for an outboard cowl and, more particularly, to an inertial lock which is actuated in response to a sudden impact on the outboard motor and which inhibits the cowl latch from releasing the cowl from its attached position.

2. Description of the Related Art

Many different types of cowl latching systems are known to those skilled in the art. The basic function of these cowl latching systems and devices is to retain a removable portion of the cowl in an attached position during operation of the outboard motor.

U.S. Pat. No. 4,875,883, which issued to Slattery on Oct. 24, 1989, discloses a latch assembly for releasably securing cowl sections of an outboard motor. A cowl assembly includes an upper cowl section and a lower cowl section. A latch assembly incorporates a pivotable hook connected to one of the cowl sections, which is engageable with a hook engaging member provided on a catch mechanism connected to the other cowl section. Due to the presence of a compressible seal between the upper and lower cowl sections, relative vertical movement is possible therebetween, and thereby between the hook and the hook engaging member. The improved latch mechanism incorporates a retainer mechanism for preventing disengagement of the hook from the catch mechanism during such relative vertical movement of the cowl sections, for ensuring that the cowl sections remain secured together during compression of the compressible seal between the cowl sections.

U.S. Pat. No. 4,927,194, which issued to Wagner on May 22, 1990, describes an interlock latch assembly for releasably securing cowl sections of an outboard motor. The interlock mechanism is provided for a latch assembly which releasably secures upper and lower cowl sections of an outboard motor. The interlock mechanism is movable between a locking position and a release position and is normally disposed in its locking position, such as by a coil spring. The interlock mechanism is mounted to the latch handle which is pivotably mounted to one of the cowl sections. A hook is interconnected with the latch handle and is engageable with a catch assembly provided on the other of the cowl sections. The interlock assembly normally engages a stationary engagement pin provided on one of the cowl sections which prevents accidental pivoting movement of the latch handle. The interlock mechanism is manually movable to its release position so that the latch handle can be pivoted so as to disengage the hook from the catch mechanism.

U.S. Pat. No. 6,669,517, which issued to Alby et al. on Dec. 30, 2003, discloses a multiple part cowl structure for an outboard motor. The structure comprises first and second cowl members which are independent components. A first cowl member is attachable, by a latch mechanism, to a support structure of the outboard motor. The second cowl member is attachable by a latch mechanism, to both the first cowl member and the support structure. The first cowl member extends across a rear portion of the outboard motor and at least partially along both port and starboard sides of the outboard motor. The second cowl member extends across a front portion of the outboard motor and at least partially along the port and starboard sides of the outboard motor. In preferred embodiment, the second cowl member also extends partially over a top portion of the outboard motor and over a rear portion of the outboard motor.

U.S. Pat. No. 6,682,379, which issued to Walczak et al. on Jan. 27, 2004, discloses a cowl latching system which simplifies the cowl removing process. The system provides a retainer that is attached to the outboard motor and a catch device which is attached to a cowl structure. The catch device is shaped to allow the retainer to move between first and second extension portions. The retainer is provided with first and second retention members that can each move from a retracted position to an extended position under the urging of a resilient member such as a spring. The first and second retention members can also be urged from their respective extended positions to their respective retracted positions by the movement of the first and second extension portions of the catch device when the cowl structure is installed onto the outboard motor. The arrangement of the catch device and retainer simplifies the installation and removal of the cowl structure from the outboard motor by allowing the operator of a marine vessel to more easily and simply move the cowl structure relative to the stationary components of the outboard motor during both the installation and removal procedures.

U.S. patent application Ser. No. 11/070,760, which was filed by Gulko et al. on Mar. 2, 2005, discloses a cowl latching mechanism for an outboard motor. The cowl latching system is provided which facilitates the installation of a removable cowl with respect to a stationary cowl structure and allows these two components to be locked together as a result of a simple downward movement in a vertical direction of the removable cowl with respect to the stationary structure. Removal of the removable cowl is also facilitated by allowing these components to be disengaged from each other as a result of a rotation of the removable cowl relative to the stationary cowl structure after a manually operable latch is released.

The patents described above are hereby expressly incorporated by reference in the description of the present invention.

It would be significantly beneficial if a system could be provided which inhibits the inadvertent separation of cowl latch components when the outboard motor is subjected to an impact force.

SUMMARY OF THE INVENTION

A cowl latch system for an outboard motor, made in accordance with a preferred embodiment of the present invention, comprises a first cowl structure, a second cowl structure, a first latch member attached to the first cowl structure, and a second latch member attached to the second cowl structure. The first and second latch members are configured to cooperate with each other to retain the first and second cowl structures in a preselected relationship relative to each other. The second latch member has a retention component which is movable between a first position, in which the first and second latch members are attached together, and a second position, in which the first and second latch members are detachable from each other. The cowl latch system, in a preferred embodiment of the present invention, further comprises an impulse sensitive locking mechanism which is configured to respond to an impulse on the outboard motor by inhibiting the retention mechanism from moving from the first position to the second position.

In a preferred embodiment of the present invention, the impulse sensitive locking mechanism is attached to the first latch member. The second cowl structure is an upper cowl which is removable from the outboard motor. The first cowl structure is a lower cowl of the outboard motor. The retention component, in a preferred embodiment of the present invention, is rotatable relative to the second latch member between the first and second positions. The impulse sensitive locking mechanism is configured to rotate about an axis of rotation in response to the impulse on the outboard motor and the center of gravity of the impulse sensitive locking mechanism is displaced from the axis of rotation. The impulse sensitive locking mechanism is configured to rotate about the axis of rotation in response to the impulse on the outboard motor because the center of gravity of the impulse sensitive locking mechanism is displaced from the axis of rotation.

The cowl latch system in a preferred embodiment of the present invention can further comprise a spring associated with the retention component. It can also comprise a lip formed at a distal end of the retention component. The impulse sensitive locking mechanism is configured, in a preferred embodiment of the present invention, to move into contact with the lip to inhibit the retention component from moving from the first position to the second position. The retention component can be a hook-shaped device which is pivotally supported by the second latch member for rotation about a pivot axis.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
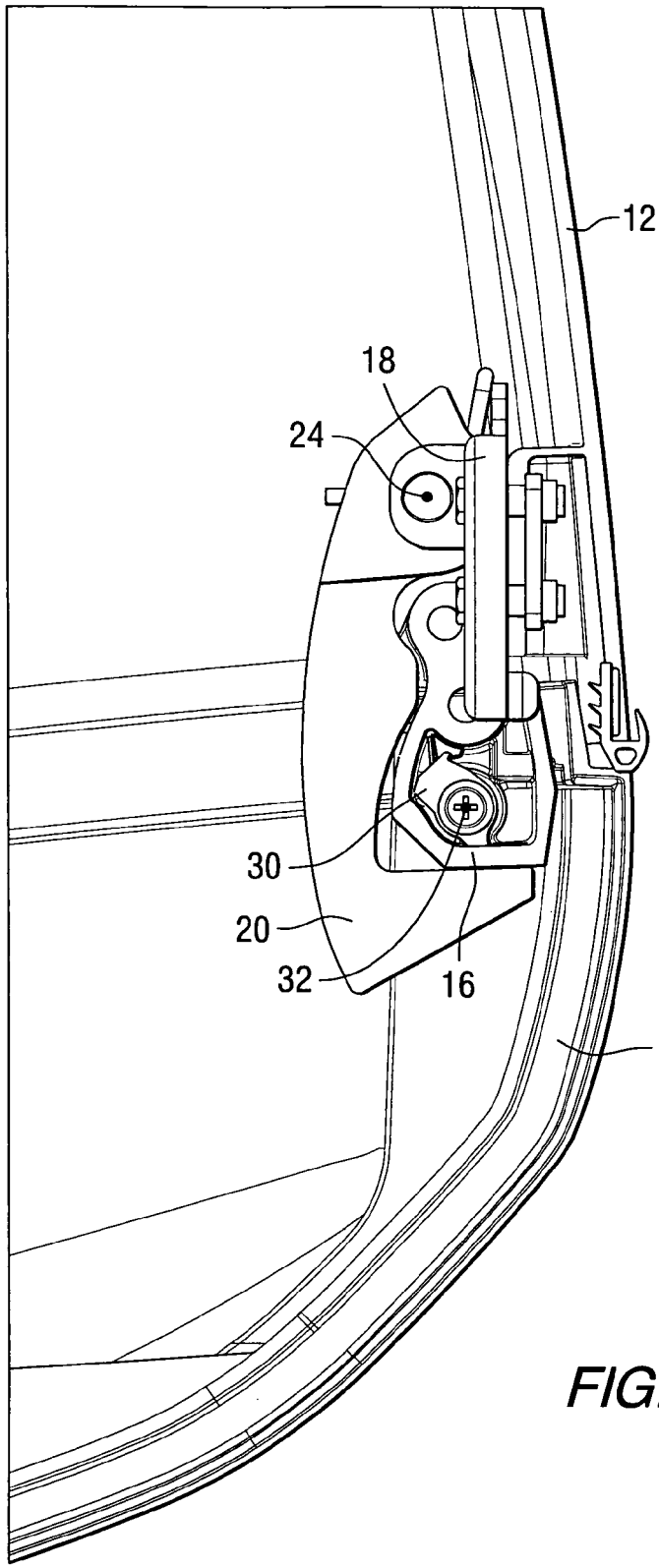
FIG. 1 is a partial section view of upper and lower cowl members attached to first and second latch members.

Throughout the description of the preferred embodiment of the present invention, like components will be identified by like reference numerals.

FIG. 1 is a partial view of a first cowl structure 10 and a second cowl structure 12. A first latch member 16 is attached to the first cowl structure 10 and a second latch member 18 is attached to the second cowl structure 12. The first and second latch members, 16 and 18, are configured to cooperate with each other to retain the first and second cowl structures, 10 and 12, in a preselected relationship relative to each other. The second latch member 18 has a retention component 20 which is movable between a first position (shown in FIG. 1) in which the first and second latch members, 16 and 18, are attached together and a second position in which the first and second latch members, 16 and 18, are detachable from each other. The second position (not shown in FIG. 1) occurs when the retention component 20 is rotated in a clockwise direction with respect to FIG. 1 about an axis of rotation 24, or pivot axis.

With continued reference to FIG. 1, a preferred embodiment of the present invention further comprises an impulse sensitive locking mechanism 30 which is configured to respond to an impulse on the outboard motor by inhibiting the retention component 20 from moving from the first position (shown in FIG. 1) to the second position.

With continued reference to FIG. 1, it can be seen that the impulse sensitive locking mechanism 30 is rotatably attached to the first latch member 16. The second cowl structure 12 is an upper cowl of an outboard motor which is removable from the outboard motor when the retention component 20 is rotated in a clockwise direction relative to the first latch member 16. The impulse sensitive locking mechanism 30 is configured to rotate about an axis of rotation 32 in response to the impulse on the outboard motor. The center of gravity of the impulse sensitive locking mechanism 30, which is not shown in FIG. 1, is displaced from the axis of rotation 32. The impulse sensitive locking mechanism 30 is configured to rotate about the axis of rotation 32 in response to the impulse on the outboard motor because the center of gravity of the impulse sensitive locking mechanism is displaced from the axis of rotation 32. As can be seen in FIG. 1, the retention component 20 is a hook-shaped device which is pivotably supported, about axis of rotation 24, by the second latch member 18. The axis of rotation 24 is therefore a pivot axis for the retention component 20.

Figure 2:
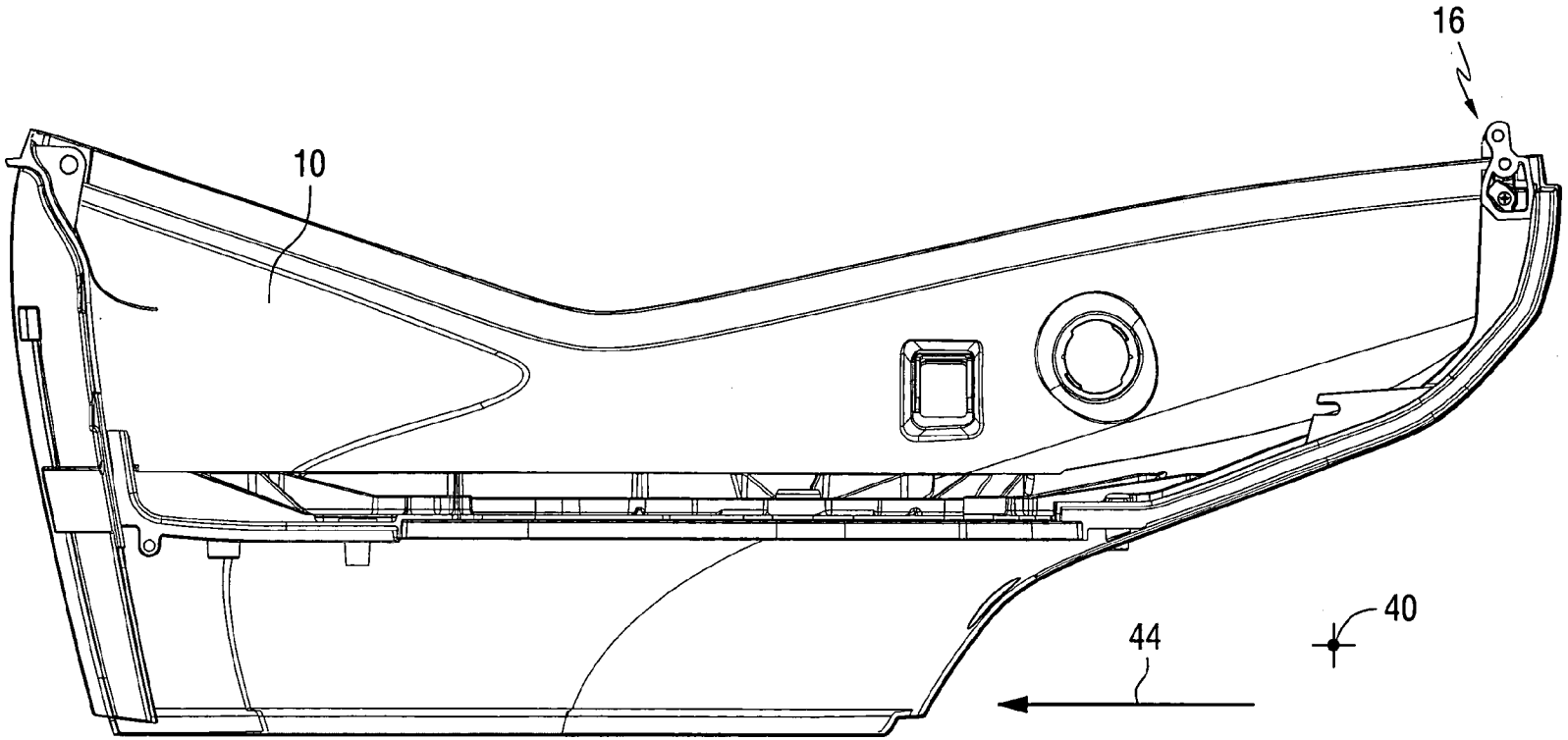
FIG. 2 shows a lower cowl member with a portion of the present invention attached to it.

FIG. 2 is a side view of the first cowl structure 10. As described above, the first cowl structure in a preferred embodiment of the present invention is a lower cowl of the outboard motor. As is generally known to those skilled in the art, an adapter plate is typically disposed within the first cowl structure 10 and an engine is typically supported by the adapter plate. Since these elements of the outboard motor are not directly related to the concept of the present invention, they are not shown. In FIG. 2, the first latch member 16 is shown at a forward portion of the first cowl structure 10. The second cowl structure is not illustrated in FIG. 2, but is shaped to be attached to the upper edge of the first cowl structure 10. Also shown in FIG. 2 is a trim axis 40 of the outboard motor which is a horizontal axis about which the outboard motor can be rotated.

With continued reference to FIG. 2, arrow 44 represents the general direction in which an impulse can be exerted on the outboard motor as a result of striking a submerged or partially submerged object, such as a log. In other words, if a marine vessel with an outboard motor travels over the submerged or partially submerged object, the lower portion of the outboard motor can strike the object with considerable force. The resulting impact on the outboard motor can have deleterious effects. This type of log strike event can cause the outboard motor to rotate about the steering axis 40. In addition, the impact of the collision can cause the first and second latch members to become disengaged or partially disengaged. The improvement provided by the present invention is intended to prevent the disengagement of the first and second latch members, 16 and 18, that might otherwise occur as a result of a sudden impulse of this type.

Figure 3:
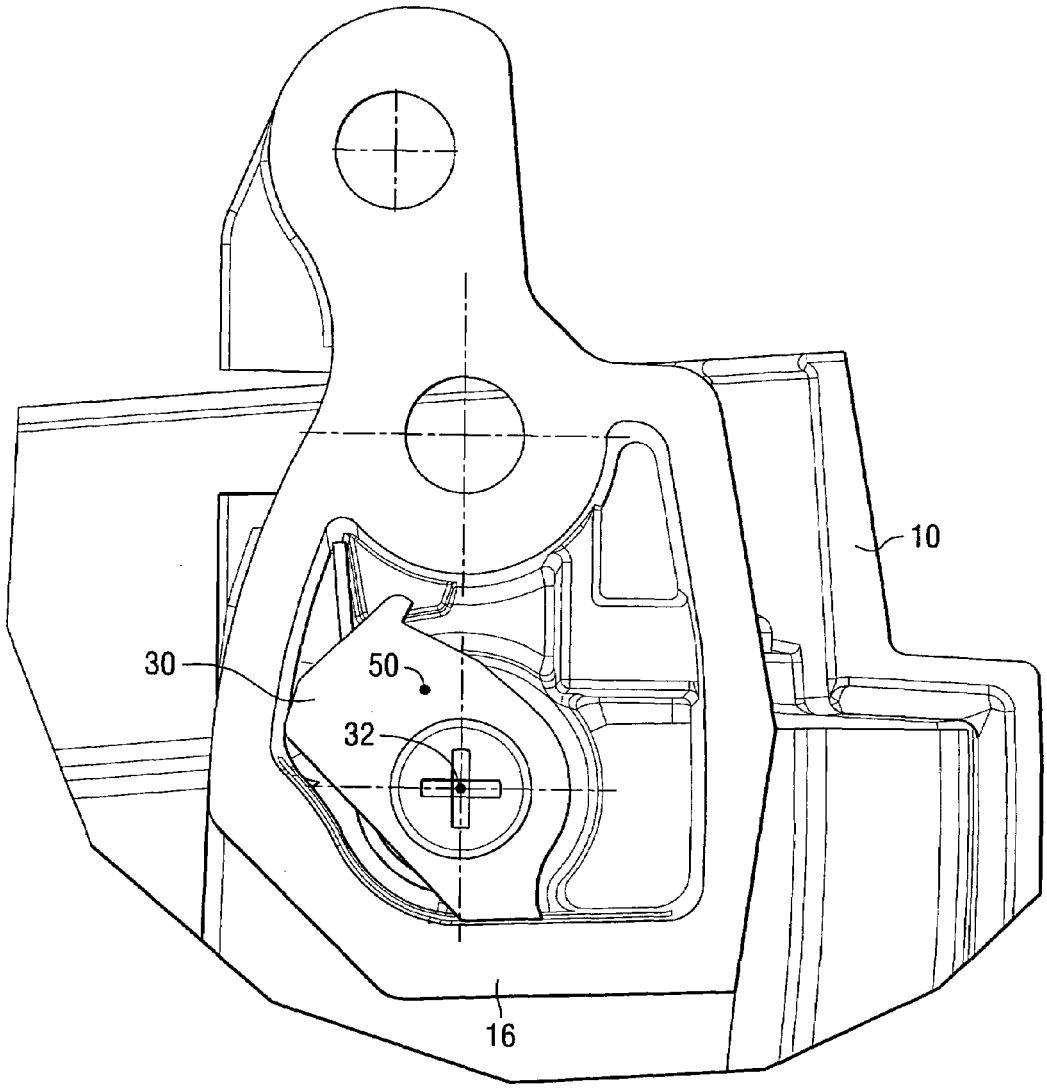
FIG. 3 is an enlarged view of a first latch member and an impulse sensitive locking mechanism.

FIG. 3 is an enlarged view of the first cowl structure 10 and the first cowl latch member 16 which is attached to it. The impulse sensitive locking mechanism 30 is shown supported for rotation about its axis of rotation 32. The point identified by reference numeral 50 in FIG. 3 represents the approximate location of the center of gravity of the impulse sensitive locking mechanism 30.

Figure 4:
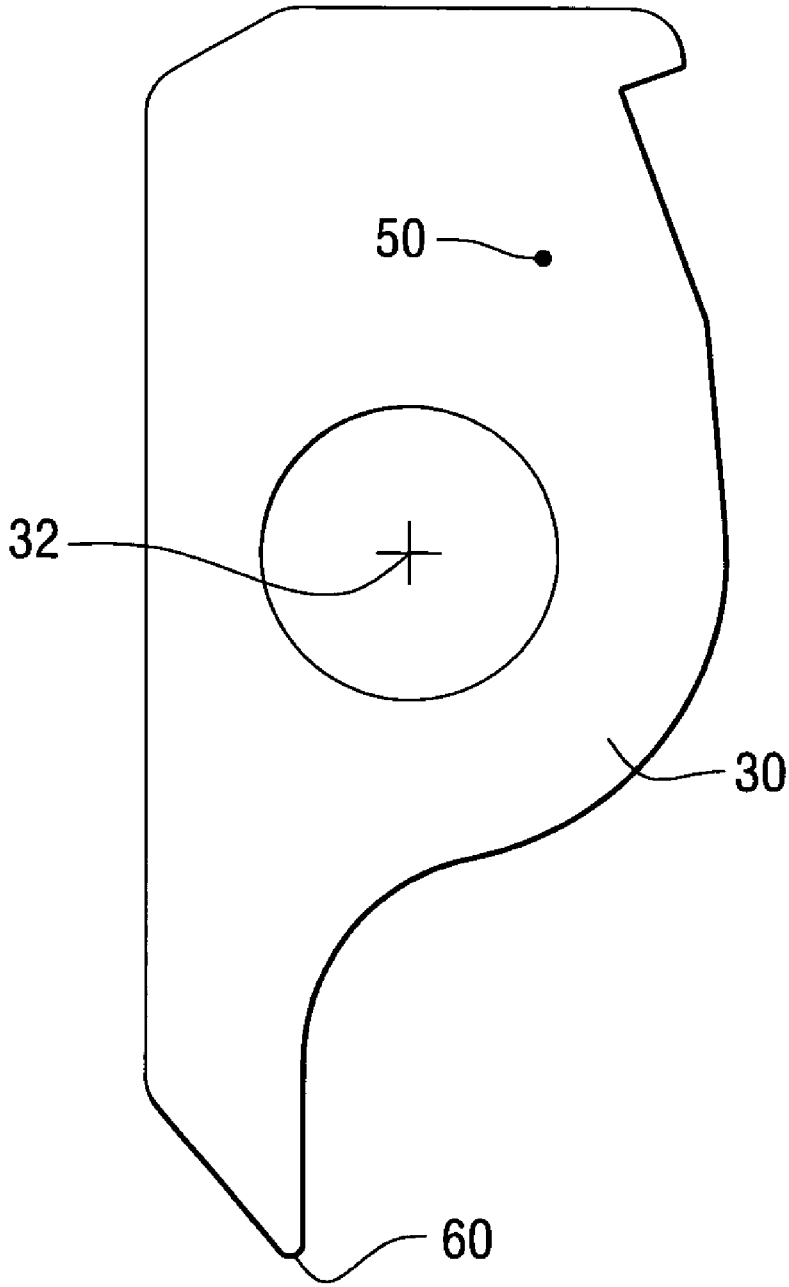
FIG. 4 is an enlarged view of the impulse sensitive locking mechanism.

FIG. 4 is an enlarged view of the impulse sensitive locking mechanism 30. The approximate location of the center of gravity 50 shows that it is displaced from the location of the axis of rotation 32. This relationship between the axis of rotation 32 and the location of the center of gravity 50 results in a rotation of the impulse sensitive locking mechanism in response to an impulse force such as that identified by arrow 44 in FIG. 2.

Figure 5:
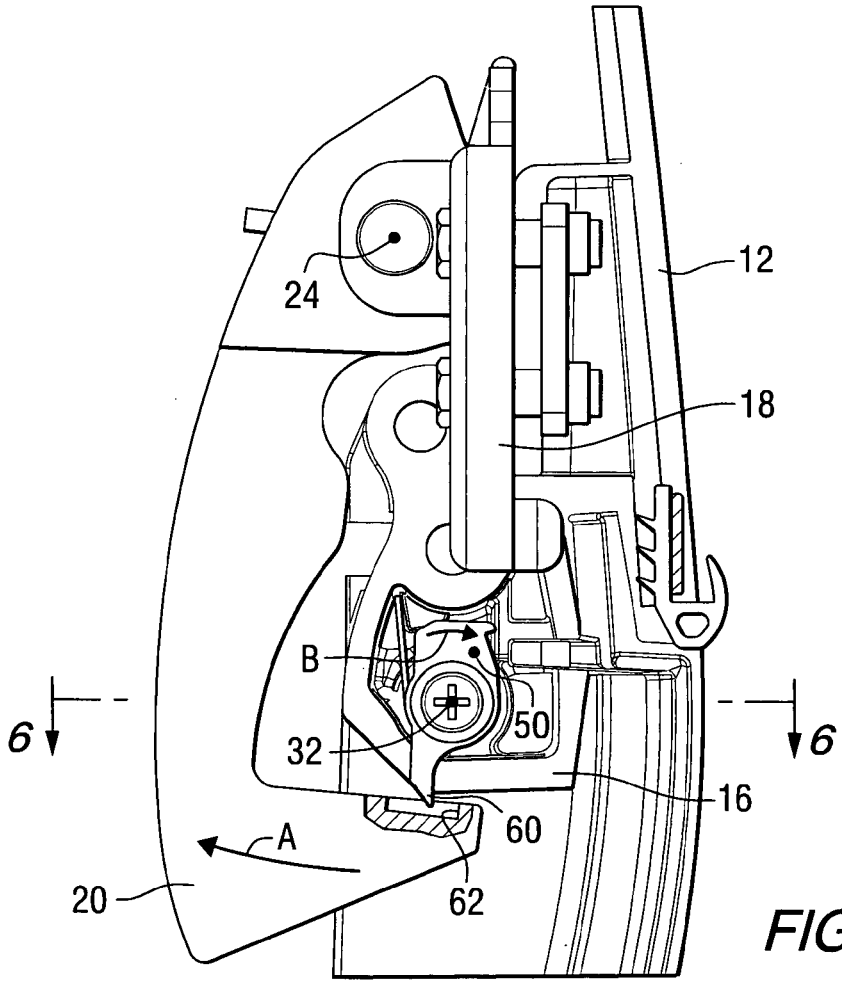
FIG. 5 is a side view of the present invention with certain components shown in phantom line to improve the visibility of the impulse sensitive locking mechanism contained therein.

FIG. 5 shows selected components of the present invention with the impulse sensitive locking mechanism 30 rotated in a clockwise direction about its axis of rotation 32 as it would be as a result of the impact described above. In response to an impulse force, such as that represented by arrow 44 in FIG. 2, the main structure of the outboard motor is rapidly moved to the left in FIGS. 2 and 5 relative to the center of gravity 50 of the impulse sensitive locking mechanism 30. This rotates an edge 60 of the impulse sensitive locking mechanism 30 into interfering relation with a lip 62 formed at a distal end of the retention component 20. The impulse sensitive locking mechanism 30 is configured to move into this relationship with the lip 62 of the retention component 20 to inhibit the retention component 20 from moving from its first position to its second position which would result from a rotation of the retention component 20 in a clockwise direction, as represented by arrow A in FIG. 5, about the pivot axis 24. The tip 60 of the impulse sensitive locking mechanism 30 is placed in this obstructing position as a result of the rotation of the impulse sensitive locking mechanism 30, in the clockwise direction represented by arrow B in FIG. 5, about its axis of rotation 32 and against a stop member that limits its clockwise motion. If the impact, represented by arrow 44 in FIG. 2, urges the retention component 20 in the direction represented by arrow A, the obstructing position of the tip 60, in relation to the lip 62, will prevent the retention component 20 from rotating sufficiently to release the first latch member 16.

Figure 6:
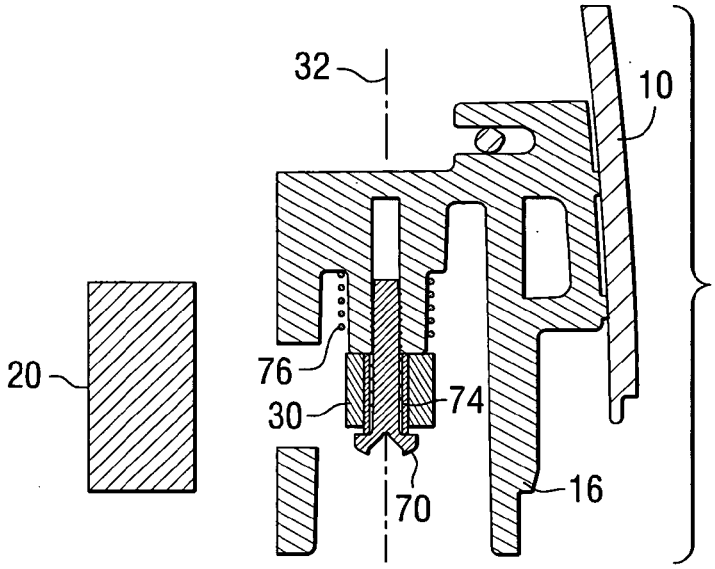
FIG. 6 is a section view of FIG. 5.

FIG. 6 is a section view taken through the axis of rotation 32 illustrated in FIG. 5. In FIG. 6, a portion of the first latch member 16 is illustrated in association with a portion of the retention component 20. The impulse sensitive locking mechanism 30 is held in position by a threaded member 70. A spacer 74 is used to prevent the threaded member 70 from binding the impulsive sensitive locking mechanism 30 in place and inhibiting its free rotation about its axis of rotation 32. A spring 76, which will be described in greater detail below, is provided to maintain the impulse sensitive locking mechanism 30 in a retracted position when no impact force, such as arrow 44 in FIG. 2, is experienced by the outboard motor.

Figure 7:
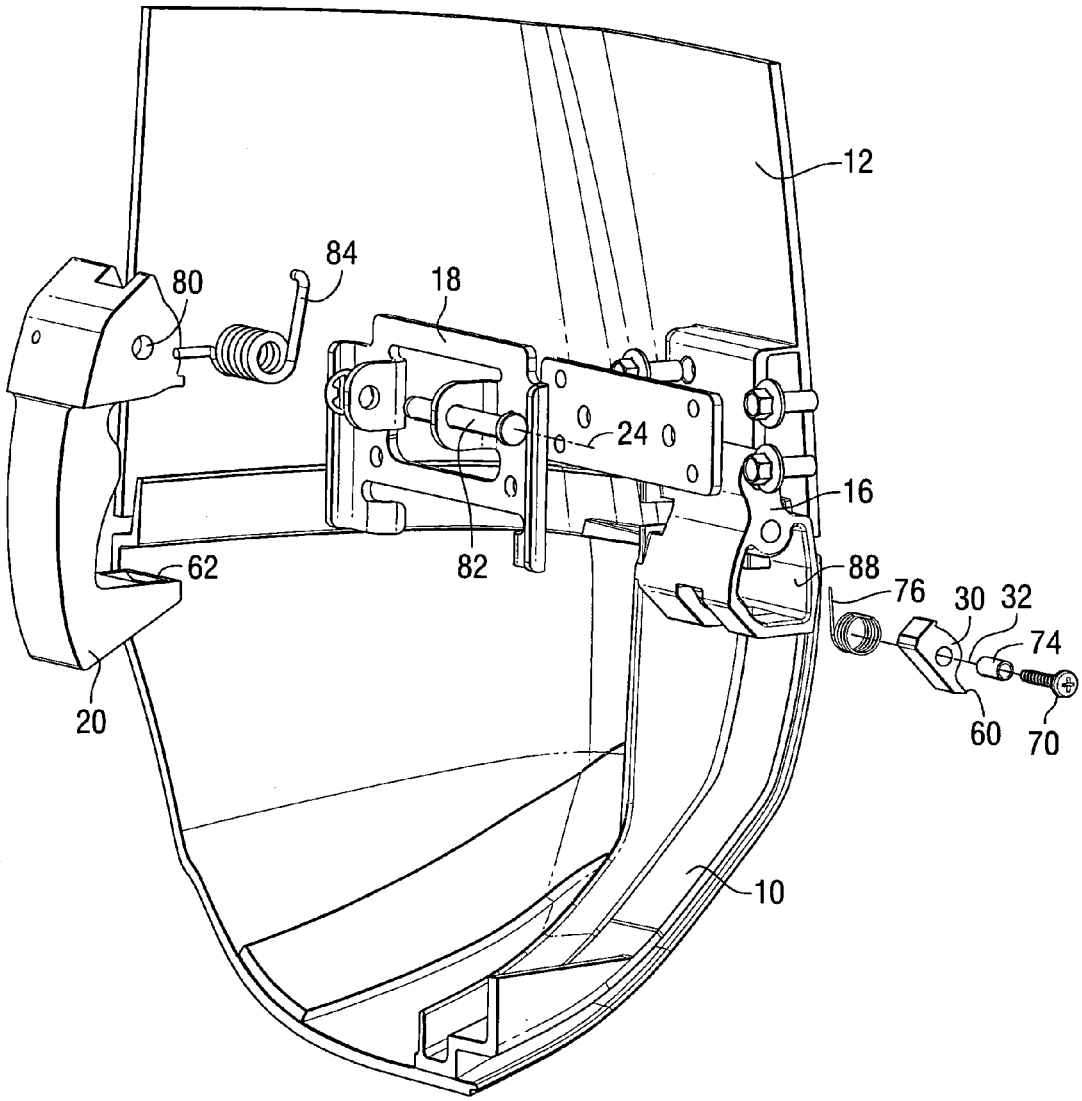
FIG. 7 is an isometric exploded view of the present invention.

FIG. 7 is an exploded isometric view of a portion of the first and second cowl structures, 10 and 12, with the latch system illustrated as individual components in the exploded view. The retention component 20 is provided with a through hole 80 that is shaped to receive a pin 82 which supports the retention component 20 for rotation about its pivot axis 24. A spring 84 is used to urge the retention component 20 in a counterclockwise direction into its latching position, or first position, illustrated in FIG. 1.

With continued reference to FIG. 7, the impulse sensitive locking mechanism 30 is received in a cavity 88 formed in the first latch member 16. The spring 76 urges the impulse sensitive locking mechanism 30 into its retracted position, as illustrated in FIG. 3, by providing a rotational force in a counterclockwise direction. The spacer 74 and threaded member 70, or screw, maintain the impulse sensitive locking mechanism 30 in its proper position relative to the axis of rotation 32.

With reference to FIGS. 1–7, a cowl latch system for an outboard motor made in accordance with a preferred embodiment of the present invention comprises a first cowl structure 10, a second cowl structure 12, a first latch member 16, and a second latch member 18. The first and second latch members are attached to the first and second cowl structures, respectively. The first and second latch members, 16 and 18, are configured to cooperate with each other to retain the first and second cowl structures, 10 and 12, in a preselected relationship relative to each other. The operation of the first and second latch members are described in U.S. patent application Ser. No. 11/070,760 which was filed by Gulko et al. on Mar. 2, 2005. The second latch member 18 has a retention component 20 which is movable between a first position in which the first and second latch members are attached together and a second position in which the first and second latch members are detachable from each other. As described above, the cowl latch system of the present invention, in a preferred embodiment, also comprises an impulse sensitive locking mechanism 30 which is configured to respond to an impulse 44 on the outboard motor by inhibiting the retention component 20 from moving from its first position to its second position. In a particularly preferred embodiment of the present invention, the impulse sensitive locking mechanism 30 is attached to the first latch member 16. The second cowl structure 12 is an upper cowl which is removable from the outboard motor in a preferred embodiment of the present invention. The first cowl structure 10 is a lower cowl in a preferred embodiment. The retention component 20 is rotatable relative to the second latch member 18 between the first and second positions. The impulse sensitive locking mechanism 30 is configured to rotate about an axis of rotation 32 in response to the impulse 44 on the outboard motor. The center of gravity 50 of the impulse sensitive locking mechanism 30 is displaced from the axis of rotation 32. The impulse sensitive locking mechanism 30 is configured to rotate about the axis of rotation 32 in response to the impulse 44 on the outboard motor because the center of gravity 50 is displaced from the axis of rotation 32. A spring 84 is associated with the retention component 20. A lip 62 at a distal end of the retention component 20 is also provided. The impulse sensitive locking mechanism 30 is configured to move into contact with the lip 62 to inhibit the retention component 20 from moving from its first position to its second position. The retention component 20 can be a hook-shaped device which is pivotally supported by the second latch member 18 for rotation about a pivot axis 24.

Although the present invention has been described in considerable detail and illustrated to show a preferred embodiment, it should be understood that alternative embodiments are also within its scope.

We claim:

1. A cowl latch system for an outboard motor, comprising:

a first cowl structure;

a second cowl structure;

a first latch member attached to said first cowl structure;

a second latch member attached to said second cowl structure, said first and second latch members being configured to cooperate with each other to retain said first and second cowl structures in a preselected relationship relative to each other, said second latch member having a retention component which is movable between a first position in which said first and second latch members are attached together and a second position in which said first and second latch members are detachable from each other; and an impulse sensitive locking mechanism which is configured to respond to an impulse on said outboard motor by inhibiting said retention component from moving from said first position to said second position.

2. The cowl latch system of claim 1, wherein:

said impulse sensitive locking mechanism is attached to said first latch member.

3. The cowl latch system of claim 1, wherein:

said second cowl structure is an upper cowl which is removable from said outboard motor.

4. The cowl latch system of claim 1, wherein:

said first cowl structure is a lower cowl of said outboard motor.

5. The cowl latch system of claim 1, wherein:

said retention component is rotatable relative to said second latch member between said first and second positions.

6. The cowl latch system of claim 1, wherein:

said impulse sensitive locking mechanism is configured to rotate about an axis of rotation in response to said impulse on said outboard motor.

7. The cowl latch system of claim 6, wherein:

the center of gravity of said impulse sensitive locking mechanism is displaced from said axis of rotation.

8. The cowl latch system of claim 7, wherein:

said impulse sensitive locking mechanism is configured to rotate about said axis of rotation in response to said impulse on said outboard motor because said center of gravity of said impulse sensitive locking mechanism is displaced from said axis of rotation.

9. The cowl latch system of claim 1, further comprising:

a spring associated with said retention component.

10. The cowl latch system of claim 1, further comprising:

a lip formed at a distal end of said retention component, said impulse sensitive locking mechanism being configured to move into contact with said lip to inhibit said retention component from moving from said first position to said second position.

11. The cowl latch system of claim 1, wherein:

said retention component is a hook-shaped device which is pivotally supported by said second latch member for rotation about a pivot axis.

12. A cowl latch system for an outboard motor, comprising:

a first cowl structure;

a second cowl structure;

a first latch member attached to said first cowl structure;

a second latch member attached to said second cowl structure, said first and second latch members being configured to cooperate with each other to retain said first and second cowl structures in a preselected relationship relative to each other, said second latch member having a retention component which is movable between a first position in which said first and second latch members are attached together and a second position in which said first and second latch members are detachable from each other, said retention component being rotatable relative to said second latch member between said first and second positions; and an impulse sensitive locking mechanism which is configured to respond to an impulse on said outboard motor by inhibiting said retention component from moving from said first position to said second position, said impulse sensitive locking mechanism being configured to rotate about said axis of rotation in response to said impulse on said outboard motor because said center of gravity of said impulse sensitive locking mechanism is displaced from said axis of rotation.

13. The cowl latch system of claim 12, wherein:

said impulse sensitive locking mechanism is attached to said first latch member;

said second cowl structure is an upper cowl which is removable from said outboard motor; and said first cowl structure is a lower cowl of said outboard motor.

14. The cowl latch system of claim 12, wherein:

the center of gravity of said impulse sensitive locking mechanism is displaced from said axis of rotation.

15. The cowl latch system of claim 12, further comprising:

a spring associated with said retention component.

16. The cowl latch system of claim 12, further comprising:

a lip formed at a distal end of said retention component, said impulse sensitive locking mechanism being configured to move into contact with said lip to inhibit said retention component from moving from said first position to said second position.

17. The cowl latch system of claim 12, wherein:

said retention component is a hook-shaped device which is pivotally supported by said second latch member for rotation about a pivot axis.

18. A cowl latch system for an outboard motor, comprising:

a first cowl structure;

a second cowl structure;

a first latch member attached to said first cowl structure;

a second latch member attached to said second cowl structure, said first and second latch members being configured to cooperate with each other to retain said first and second cowl structures in a preselected relationship relative to each other, said second latch member having a retention component which is movable between a first position in which said first and second latch members are attached together and a second position in which said first and second latch members are detachable from each other, said retention component being rotatable relative to said second latch member between said first and second positions; and an impulse sensitive locking mechanism which is configured to respond to an impulse on said outboard motor by inhibiting said retention component from moving from said first position to said second position, said impulse sensitive locking mechanism being configured to rotate about said axis of rotation in response to said impulse on said outboard motor because said center of gravity of said impulse sensitive locking mechanism is displaced from said axis of rotation.

19. The cowl latch system of claim 18, wherein:

said impulse sensitive locking mechanism is attached to said first latch member, the center of gravity of said impulse sensitive locking mechanism being displaced from said axis of rotation;

said second cowl structure is an upper cowl which is removable from said outboard motor; and said first cowl structure is a lower cowl of said outboard motor.

20. The cowl latch system of claim 19, further comprising:

a spring associated with said retention component; and a lip formed at a distal end of said retention component, said impulse sensitive locking mechanism being configured to move into contact with said lip to inhibit said retention component from moving from said first position to said second position, said retention component being a hook-shaped device which is pivotally supported by said second latch member for rotation about a pivot axis.

* * * * *